United States Patent [19]

Roach

[11] Patent Number: 4,490,945

[45] Date of Patent: Jan. 1, 1985

[54] STYLUS MANUFACTURING APPARATUS AND METHOD

[75] Inventor: William R. Roach, Rocky Hill, N.J.

[73] Assignee: RCA Corporation, New York, N.Y.

[21] Appl. No.: 478,096

[22] Filed: Mar. 23, 1983

[51] Int. Cl.[3] ..... B24B 49/00

[52] U.S. Cl. ..... 51/165 R; 51/209 R; 51/281 R; 51/325; 369/71; 369/277

[58] Field of Search ..... 51/165 R, 209 R, 281 R, 51/325; 369/71, 126, 277

[56] References Cited

U.S. PATENT DOCUMENTS

| | | | |
|---|---|---|---|
| 528,273 | 10/1894 | Lioret | 369/277 |
| 915,936 | 3/1909 | Cheney | 369/277 |
| 1,303,074 | 5/1919 | Leake | 369/277 |
| 3,842,194 | 10/1974 | Clemens | 178/6.6 A |
| 4,104,832 | 8/1978 | Keizer | 51/281 |
| 4,328,646 | 5/1982 | Kaganowicz | 51/281 R |
| 4,369,604 | 1/1983 | Kaganowicz | 51/281 R |

*Primary Examiner*—Harold D. Whitehead

*Attorney, Agent, or Firm*—Birgit E. Morris; Donald S. Cohen; Joseph D. Lazar

[57] ABSTRACT

A keel-tipped stylus for playback of video information from a disc record is formed on a lapping disc having a spiral signal track on the land between a spiral lapping groove. The respective pitches of the signal track and groove are different whereby the signal track and lapping groove cross each other. A playback stylus riding in the groove will detect a signal from the track to monitor the lapping process.

6 Claims, 17 Drawing Figures

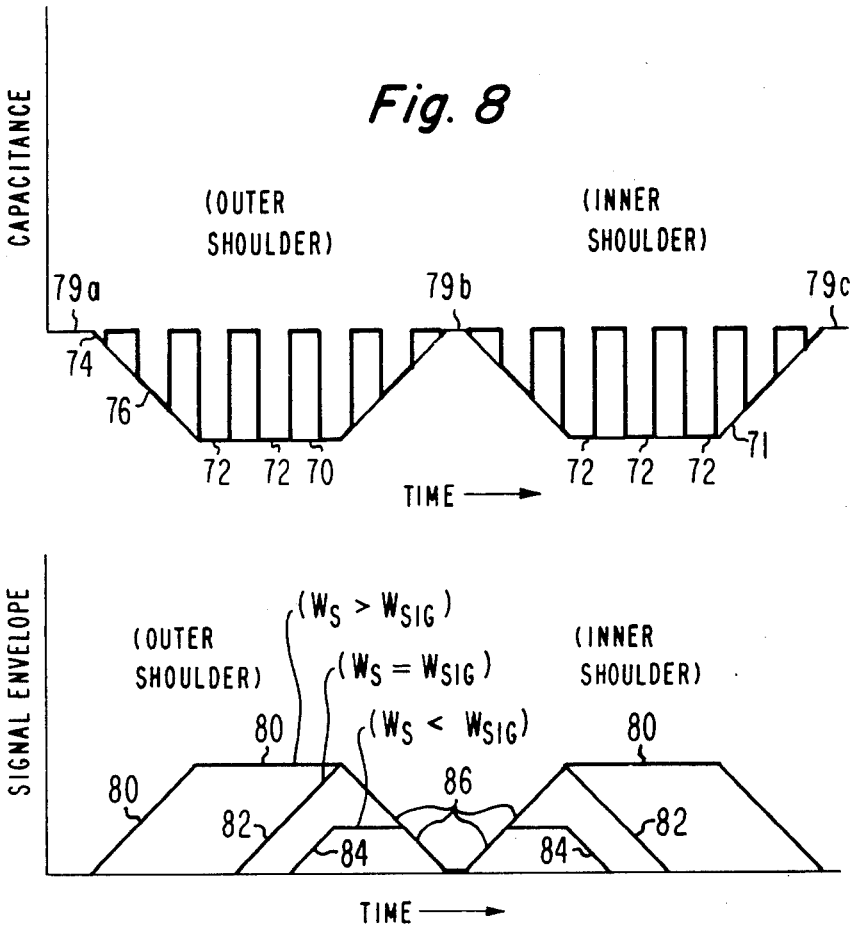
Fig. 8
Fig. 9
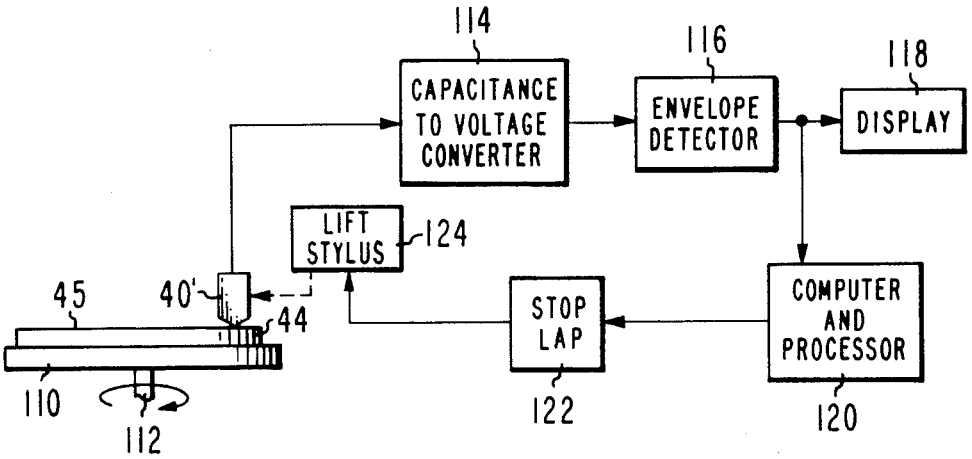
Fig. 14

STYLUS MANUFACTURING APPARATUS AND METHOD

This invention relates to an apparatus and method for manufacturing a stylus, and more particularly, for testing a playback stylus while the stylus keel is being lapped.

BACKGROUND OF THE INVENTION

Clemens, in U.S. Pat. No. 3,842,194, discloses an information recording and playback system which utilizes variable capacitance. In one configuration, information representative of recorded picture and sound is encoded in the form of a relief pattern in a relatively fine spiral groove on the surface of a disc record. The disc record is overcoated with a conductive layer followed by a dielectric layer and in turn by a lubricant layer. Recent developments have resulted in the use of a conductive disc material which eliminates the need for discrete conductive and dielectric layers. For example, groove widths of about 2.5 micrometers and groove depths of about 0.5 micrometer may be used. During playback a pickup stylus fabricated from a dielectric support element having a tip about 2 micrometers wide having a thin conductive electrode thereon, for example, about 0.2 micrometer thick, engages the groove as the record is rotated on a supportive turntable. Capacitive variations between the stylus electrode and the record surface are sensed to recover the prerecorded information.

Keizer, in U.S. Pat. No. 4,104,832, discloses a method for forming a keel-tipped stylus. A tapered dielectric support element made from a hard dielectric material, such as diamond, is placed in contact with an abrasive lapping disc having a deep trapezoidally-shaped, coarsely pitched, spiral groove. Relative motion is established between the support element and the lapping disc. The lands of the lapping disc lap the shoulders of the keel-tipped playback stylus and the side walls of the groove serve to form the slightly tapered side surfaces of the constricted terminal portion of the stylus.

In the aforementioned Keizer method U.S. Pat. No. 4,101,832 the abrasive lapping disc may be formed, if desired, by employing optical recording techniques. To that end, Keizer describes a flat, smooth, copper-clad substrate that is coated with a thick coating of photoresist, for example, approximately 4.0 micrometers in thickness. The photoresist-coated substrate is then exposed to a focused laser beam, for example, about 2.0 micrometers in diameter at the focus, along a spiral track which has a pitch that is considerably coarser than that of a disc record. For example, the coarse pitch might be 6–10 micrometers. The exposed photoresist is developed to form a spiral groove in the photoresist. The developed photoresist layer is coated with a conductive metal layer, generally 0.12 micrometer of gold, applied by evaporation from a liquid in a vacuum chamber. Metal stampers, made from the substrate by standard plating techniques, may then be used to press plastic lapping discs having a groove of substantially the same shape and size as the groove which was formed in the photoresist layer. An abrasive material, such as $SiO_x$, wherein x is between 1 and 2, may be glow discharge deposited on the plastic disc to form an abrasive layer suitable for lapping a keel-tipped playback stylus. Kaganowicz in his U.S. Pat. No. 4,328,646, issued May 11, 1982 and entitled, "Method for Preparing an Abrasive Coating," discloses, abrasive $SiO_x$ coating which may be advantageously employed.

Kaganowicz in U.S. Pat. No. 4,369,604, issued Jan. 25, 1983 entitled, "Method and Apparatus for Mechanically Preparing Stylus Lapping Discs," discloses a method and apparatus for electromechanically preparing lapping discs. A deep groove is mechanically cut into a metal substrate surface with a diamond cutting tool. The diamond cutting tool tip has a shape complementary to the shape of the groove to be formed in the surface of the substrate. During the mechanical cutting operation, the tip of the stylus is introduced into the metal surface to a depth sufficient to cut the groove to the desired depth across the surface of the metal substrate. A signal track is mechanically cut on the lapping disc surface by a cutting stylus to provide a signal for monitoring the subsequent lapping of the tip (i.e., the keel) of the playback stylus. The signal can be cut into the spiral groove or cut into the land between the spiral groove of the lapping disc. The pitch of the groove and either of the two forms of signal tracks are equal. The signal from the track is sensed during the lapping operation to indicate when the desired width of the shoulder of the tip is achieved.

SUMMARY OF THE INVENTION

I have discovered a method and apparatus for measuring the shoulder width of a keel-type stylus during the keel lapping process by sensing the envelope of a signal recorded as a spiral signal track of one pitch on the land of a lapping disc groove with a different pitch. The signal track crosses the disc groove to provide thereby a signal waveform envelope indicative of the width of the stylus shoulder. The signal track is recorded on the master substrate which is used to generate the lapping discs by developing suitably a laser-exposed photoresist and then etching with a weak etchant. The surface is kept wet during the entire process from the start of development to the completion of etching.

BRIEF DESCRIPTION OF THE DRAWING

FIG. 8 is a graph of capacitance vs. time representing the signal output of a stylus as it approaches and recedes from the intersection of a lapping control signal track with a lapping groove;

FIG. 9 is a graph of the recovered signal envelope vs. time for representative stylus shoulder widths;

FIG. 14 is a system using the invention for lapping a stylus from a lapping disc made from the master of FIG. 13.

DETAILED DESCRIPTION OF A PREFERRED EMBODIMENT

Figure 1:
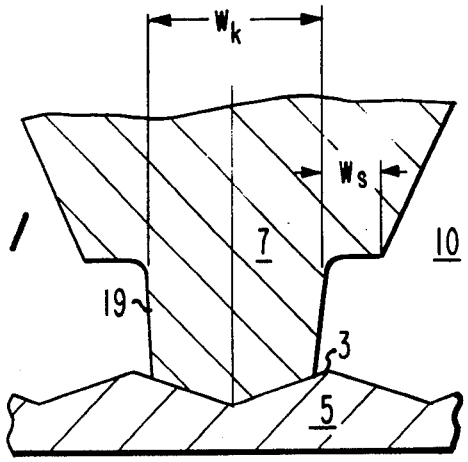
FIG. 1 illustrates a keel-tipped playback stylus riding in a disc groove.

FIG. 1 shows a pickup or playback stylus 10 riding in a V-shaped groove 3 disposed on the surface of a video disc 5, also called a playback disc or record. In video disc systems of the variable capacitance type, such as the aforementioned Clemens system, the stylus is moved relative to the groove. Capacitance variations between a conductive electrode on the stylus face 7 and a conductive property of the video disc 5 are decoded by suitable signal processing circuitry for display on a television receiver. To obtain adequate playback time, the groove convolutions on the video disc 5 are relatively closely spaced (e.g., groove pitch is 2.5 micrometers). In accordance with the aforementioned Keizer patent, the pickup stylus 10 has a constricted terminal region 19 (i.e., keel-tip).

Figure 2:
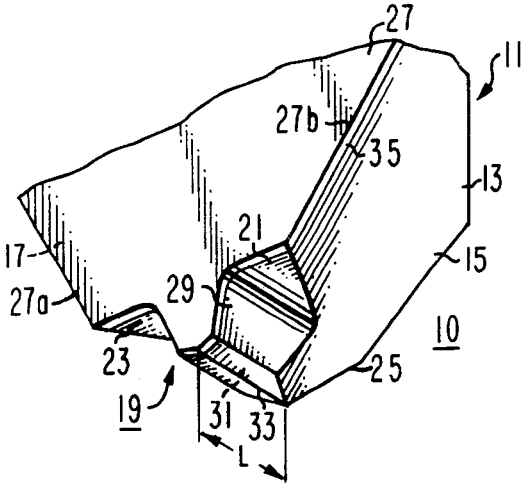
FIGS. 2 and 3 show perspective views of a keel-tipped stylus.
Figure 3:
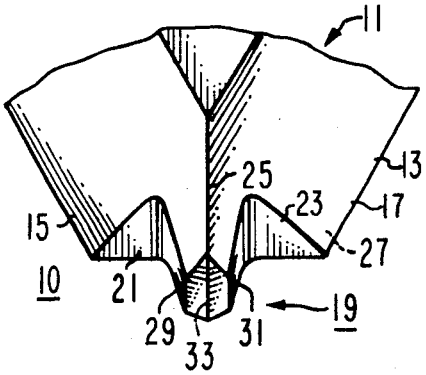

FIGS. 2 and 3 show perspective views of the keel-tipped playback stylus 10 in greater detail. As shown in the respective figures, the keel-tipped stylus 10 includes a dielectric support element 11 formed from a material such as diamond. The dielectric support element 11 comprises a body 13 having bevelled surfaces 15 and 17, and shoulders 21 and 23 joining the bevelled body to the constricted terminal portion (keel-tip) 19.

The constricted terminal portion (keel-tip) 19 is defined by a prow 25, a substantially flat rear surface 27 remote from the prow 25, a pair of substantially parallel side surfaces 29 and 31 extending from the rear surface 27, and a bottom V-shaped surface 33 extending from the bottom edge of the rear surface 27. The bottom surface 33 is preferably conformed to the shape of the groove bottom of the playback disc 5. A coating 35 of conductive material is provided on the flat rear surface 27. The conductive coating 35 may be used as one electrode of the aforementioned capacitance system.

The fabrication of the keel tip 19 of the playback stylus will now be discussed with reference to FIGS. 4 and 5. A V-shaped stylus support 40 to be lapped is made to engage the surface of a groove 42 of an abrasive lapping disc 44. The stylus support 40 is to be designated 40′ after the keel-tip 19 is formed on the stylus support 40. The keel tip 19 is formed on the stylus support 40 by running the V-shaped stylus support 40 on abrasive lapping disc 44 having the deep coarse-pitched groove 42. The lands 46 and 48 on the lapping disc 44 lap the shoulders 21 and 23 of the stylus 40 and the walls 54 and 56 of the abrasive groove 42 form the substantially parallel side surfaces 29 and 31 of keel 19. The abrasive groove 42 is provided with V-shaped bottom surface 64 which is shaped to form a stylus shoe which conforms to the shape of the groove bottom of the playback disc 5 (FIG. 1).

The groove 42 is provided with radii 66 and 68 formed between the groove walls 54 and 56 and the land portions 46 and 48, respectively. Radii 66 and 68 provide a smooth transition between groove walls 54 and 56 and land 46 and 48. The smooth transition at the corners of the playback stylus reduces the incidence of playback stylus breakage during signal recovery. By suitable modification of the groove profile, other shapes may be provided on the various surfaces of the stylus keel 19 that are normal to the back surface 27.

Figure 5:
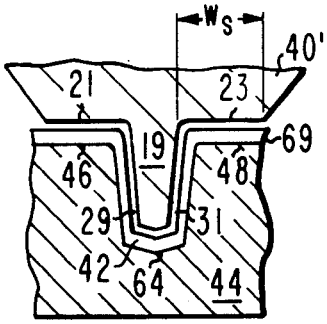

The width ($W_s$) of the respective stylus shoulders 21 and 23 is shown in FIG. 5. The length (L) of the stylus shoe is shown in FIG. 2. In the manufacture of the stylus 10, the stylus shoe length must be maintained within narrow limits. According to this invention, I monitor the development of the shoulder width $W_s$ during the lapping process to thereby monitor, indirectly, the length L. The length L is known to be geometrically related to the shoulder width $W_s$. See FIGS. 15 and 16 for sketches of the geometry in fragmentary rear (viewing electrode surface 27) and side views, respectively, of the preferred stylus 10 shown in FIGS. 2 and 3.

Figure 16:
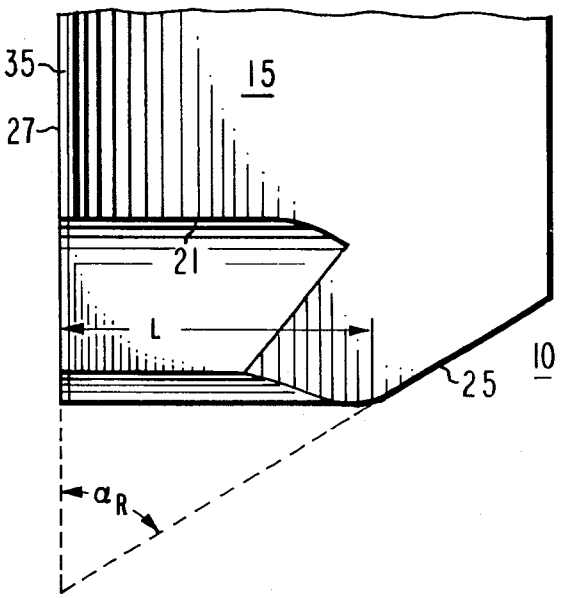
FIG. 15 and 16 are schematics showing the geometry of a stylus.
Figure 15:
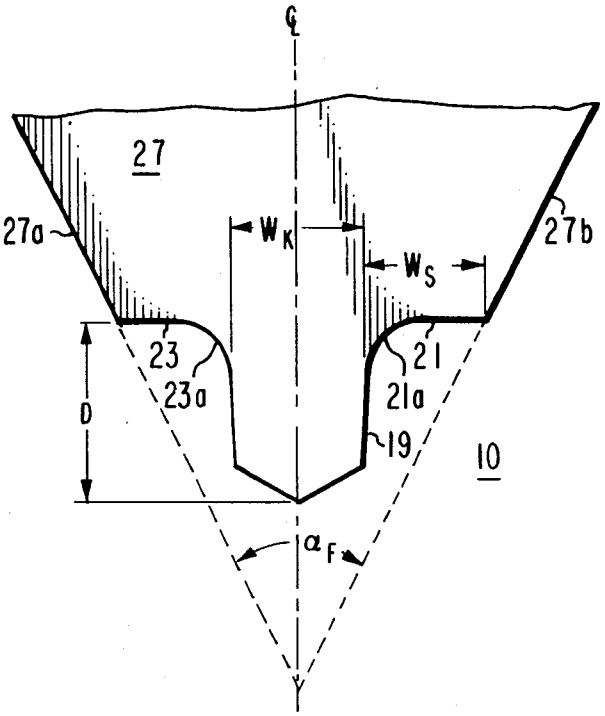

In the stylus configuration illustrated in FIGS. 15 and 16 it can be shown that the length (L) is:

$$L = \left[ \frac{W_s + \frac{W_k}{2}}{\tan \frac{\alpha_F}{2}} - D \right] \tan \alpha_R \tag{1}$$

where $W_k$ is the width of the keel 19, $W_s$ is the shoulder width of the keel 19, D is the depth of the keel 19 and thus equal to the depth of the groove 42 (FIG. 4), $\alpha_R$ is the angle of the prow 25 extended to meet the extention of flat back surface 27, and $\alpha_F$ is the angle of the surface 27 defined by the extension of surface edges 27*a* and 27*b*.

Figure 6:
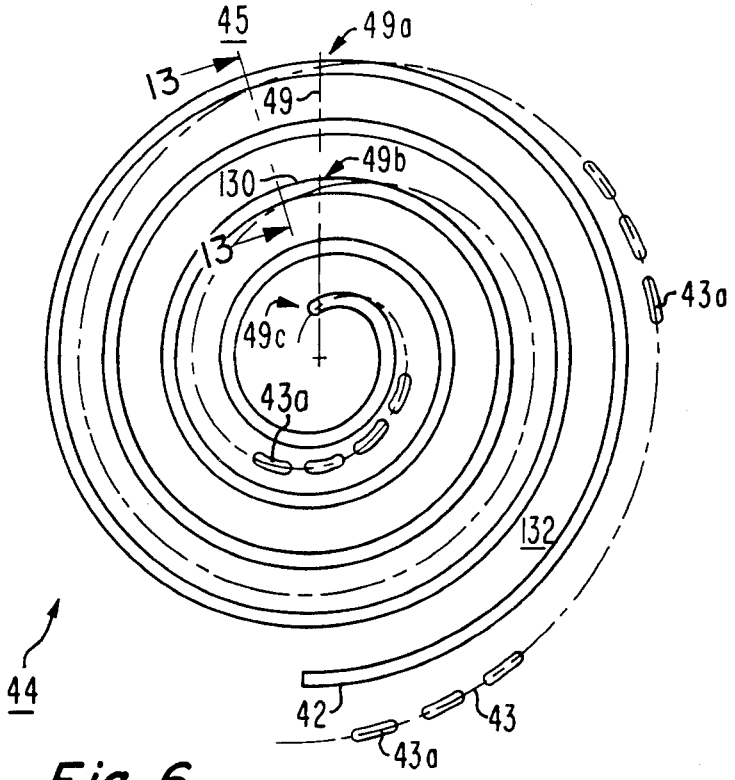
FIG. 6 is a schematic top view of a keel lapping disc containing a lapping control signal track according to the invention.

FIG. 6 is a schematic top view of a preferred embodiment of the lapping disc 44 (FIGS. 4 and 5) for lapping a stylus according to the present invention. The upper surface 45 of the lapping disc 44 contains the continuous spiral groove 42 of a given pitch. The groove 42 has a cross section profile that is complementary to the keel-shaped tip 19 of both a cutting stylus and a playback stylus (FIG. 1), is of a coarse pitch and is suitably treated on its surface with a metal coating and an abrasive material 69 (FIG. 4) so that disc 44 serves as a lapping disc with groove 42 being the lapping groove suitable for keel lapping. However, other groove profiles suitable for lapping styli of another geometry or other tracking signal arrangements may also be employed. Moreover, such a "lapping," disc with a conductive surface but with a nonabrasive dielectric layer could be used to measure the stylus length.

A signal spiral track 43 is provided with a relief pattern for example, of a continuous series of evenly spaced segments 43*a* to effect a constant amplitude signal recorded on the shoulder 46, 48 (FIG. 5*a*) between the groove 42. The segments 43*a* are shown in enlarged form in FIG. 7, to be described. Track 43 is provided with a pitch coarser than the pitch of groove 42 and accordingly intersects groove 42 to cross it diagonally in a predetermined relation, as will be described. A stylus (10, FIG. 1; 40′ FIG. 5) of the type described in Keizer's U.S. Pat. No. 4,162,510, riding in groove 42, when relative motion is established between the disc 44 and the stylus 40′, will periodically intersect the path of the signal track 43 at points 49*a*, 49*b*, and 49*c*. The stylus 40′, in a well-known manner, will generate a capacitance varying signal from the recorded signal in track 43. The signal will have an amplitude envelope proportional to the overlap between the stylus electrode 35 and the signal track 43 as the stylus 40' approaches and recedes from such intersections. The signal derived from this process is used to obtain information indicative of the structure of the stylus electrode shoulder, i.e. the width of the upper portion of the keel that widens into shoulder 21 and 23 (FIG. 5) as well as to infer other dimensions of the geometry of the stylus, i.e. the shoe length.

The groove 42 and the signal track 43 may be arranged to intersect each other at any angle as defined by the tangents of the two spiral paths at the point of intersection. I have discovered that a very small intersection angle, approaching but not a zero angle, is preferred in order to give a more accurate interpretation of the observed signal envelope in terms of shoulder widths. Furthermore, I have found that in order to be able to unambiguously establish what portion of the signal is picked up by which shoulder (e.g. shoulder 21 or 23, FIG. 5), it is preferable for the spiral groove 42 and track 43 to intersect each other once per every other groove turn, as at points 49*a*, 49*b*, and 49*c* although more frequent or less frequent intersections may also be employed.

The signal track 43, formed of the serial signal elements 43*a*, crosses the lapping groove 42 preferably along a common radial line 49. In the embodiment shown in FIG. 6, track 43 crosses groove 42 at every other turn at points 49*a*, 49*b* and 49*c* on line 49. The pitch of signal track 43 is thus less than the pitch of groove 42.

Figure 5A:
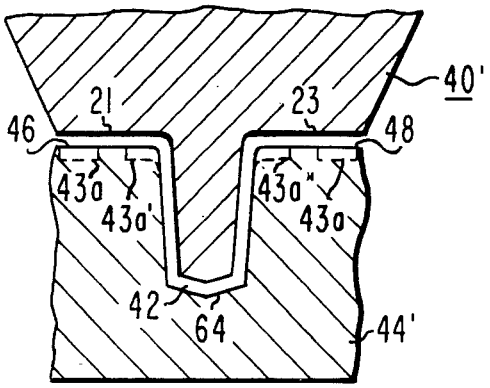
Figure 7:
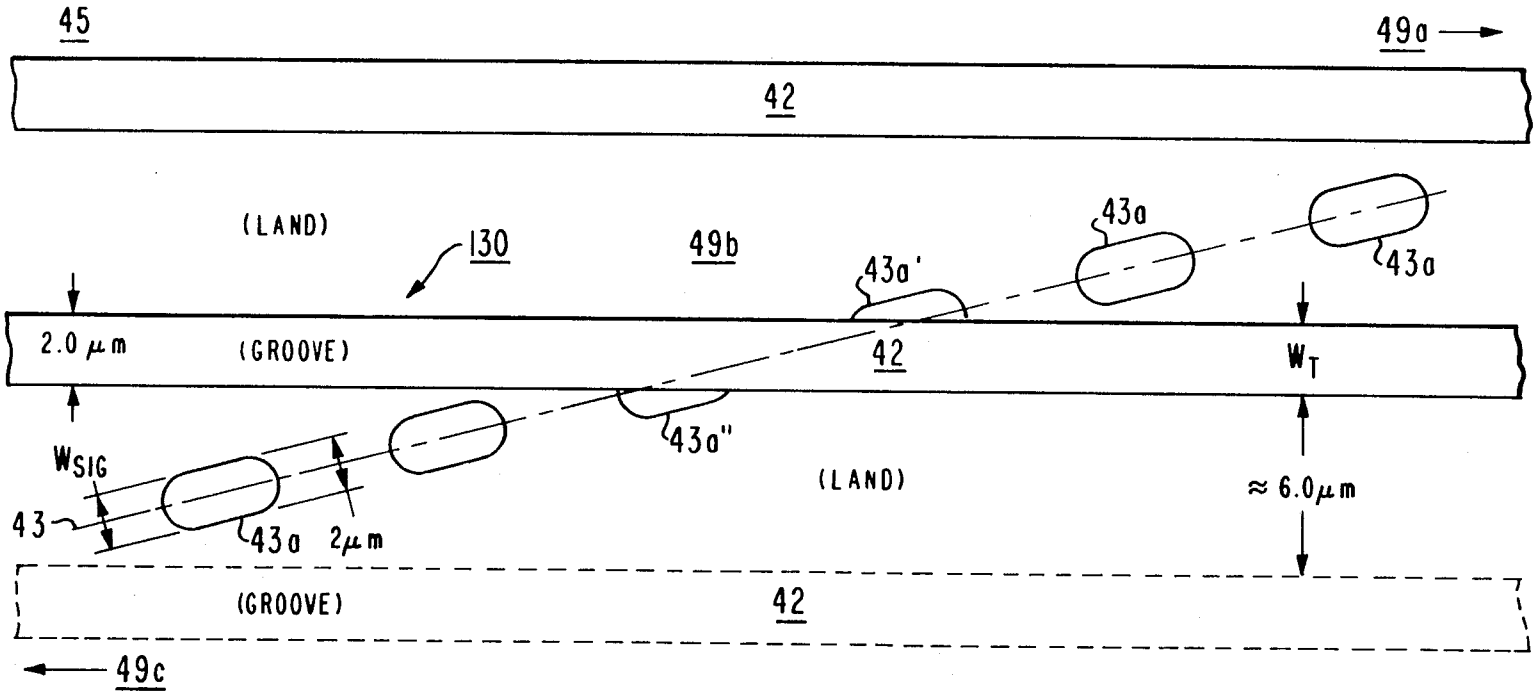
FIG. 7 is a schematic top view of the intersection of a lapping groove with a signal track of a keel lapping disc having a recorded lapping control signal.

The length (e.g. 4 μm) and the width (e.g. 2 μm) of each element 43*a* is preferably uniform from element to element. This is achieved by recording a signal that is substantially uniform in amplitude. As shown in FIG. 7, which is a top schematic view of an enlarged portion of the lapping disc 44, the lapping groove 42 and the signal track 43 intersect in the vicinity of the intersection portion 49*b* (FIG. 6) of the lapping disc 44. The relative location of intersection points 49*a* and 49*c*, respectively, two spiral turns of the groove 42 away from point 49*b*, are indicated by the arrows. The portion of the signal element 43*a* which does not in any way intersect with the groove 42 will be of full length and width. However, as the portion of signal track 43 intersects the groove 42, more and more portions of the respective signal elements 43*a* will be eliminated. As seen in FIG. 7 such fragmented signal elements 43*a'* and 43*a''* on respective opposite edges of the groove 42, are all that remain of an otherwise full size element 43*a*. FIG. 5*a*, a simplified illustration of FIG. 5, shows the lapping disc 44', similar to disc 44 of FIG. 5, but with the signal elements 43*a*, 43*a'* and 43*a''* provided in the shoulders 46 and 48. A method of making such a signal track on the shoulders 46 and 48 will be described hereinafter.

Assume a keel-tipped stylus having relatively narrow shoulders 21 and 23 of 2.0 μm as compared to the period of 8 μm of groove 42. The signal sensed by the respective inner (23) and outer (21) shoulders of such a stylus from the signal elements 43*a* etc. (FIG. 5*a*) as it passes through groove 42 intersected by a signal track 43 will generate a signal having capacitance amplitude envelopes 70 and 71 as shown in FIG. 8.

FIG. 8 is a plot of such envelopes (shown in simplicity as trapazoids) which are derived from capacitance variations as a function of time developed from the individual amplitude elements 72, 73, 74, 75, 76, etc. Envelope 70 is developed from the outer shoulder of the stylus 40' approaching a passing the signal track 43, while envelope 71 is developed from the inner shoulder of the stylus. Signal elements 43*a* are, in the preferred embodiment, recesses in the land 48 (FIG. 5*a*), between the spiral groove 42. Elements 43*a* could alternatively be bumps on the land 48. In either form, the elements 43*a* are sensed by the electrode 35 of the stylus 40' as a varying capacitance as the stylus electrode 35 passes over the signal track 43. Each of the amplitude elements 72, 74, 76, 78 has an amplitude proportional to the width of the stylus electrode that overlaps the signal element 43*a* and inversely proportional to the (vertical) distance between the electrode 35 and the signal elements 43*a*. Maximum amplitudes, as for example, elements 72, are derived from a stylus shoulder that completely covers a full width element 43*a*, while smaller amplitudes 74, 76, 78, are derived from the combined effect of narrower signal elements such as elements 43*a'* and 43*a''* (FIGS. 5*a* and 7) and decreased overlap distances between the shoulder of the stylus and the signal elements as when the signal track gets farther away from the groove 42. No capacitive variations will be sensed at the cross-over points 49*a*, 49*b* and 49*c* (FIG. 7), etc. Cross-over point 49*b* appears as sensed null amplitude segment 79*b* between the signal envelopes 70 and 71. The capacitance envelope signals 70 and 71, in general, are likewise zero in the region of the disc in which therr are no signal track elements 43*a*, etc., such as region 130 shown in FIG. 7 and also in FIG. 6. Thus, any surface region over which a stylus electrode passes without sensing a signal track is such a region as region 130. Region 132 shown in FIG. 6 is also a region which will provide no capacitance signals. These critical disc locations are represented by zero amplitude points 79*a* and 79*c* at the ends of the envelopes 70 and 71.

Measurements of the capacitance between the stylus electrode 35 and the lapping disc surface 45 is advantageously made during the lapping process, that is, the process during which a stylus is machined by lapping to conform to the shape of the lapping groove 42. The envelopes 70 and 71 detected from signal track 43 may be used to determine the width ($W_s$) of each shoulder of the stylus, and, from the known faceting angles of the stylus related to the length (L) of the stylus shoe, as will be further explained in the discussion of FIGS. 15 and 16. In brief, if one knows the width of both the groove 42 ($W_k$) and the signal track 43 ($W_{sig}$), all the information necessary to determine the stylus shoulder width ($W_s$) resides in the shape of the respective shoulder envelopes 70 or 71 of the detected signal. Although the strength of the capacitive signal is inversely proportional to the distance that the stylus electrode rides above the conductive surface of the disc (and therefore upon the abrasive layer (69) thickness and dielectric constant), the slope of the signal envelope 70 or 71 when normalized to its peak height, is independent of those parameters. Moreover, since the time scale of FIG. 8 can be normalized to the time between signal track and groove crossovers, the envelope display likewise can be made independent of turntable rotational speed.

A signal track 43 can be recorded on the surface 45 of disc 44 without having to register at a predetermined angle precisely with the groove although to insure that the envelope slopes are symmetrical the centering requirements for the respective spirals are moderately severe. If the two pitches are integrally related, the intersection will lie along one (radius 49, FIG. 6) or, a discrete set, of radii. For example, if a signal track 43 was recorded at a pitch 2× as coarse as the pitch of a lapping groove 42, the resulting disc would appear with one cross over of the stylus with the signal track 43 per two rotations of the disc 44 illustrated in FIG. 6.

FIG. 7, it should be understood, represents the spiral tracks 43 and 42 of FIG. 6 as if they were unfolded to a linear form for the special case wherein the signal track (43) width is the same as the groove (42) width. If the signal track width $W_{sig}$, as indicated in FIG. 7, is designed to be the same width as the desired shoulder width ($W_s$, 23, FIG. 5) to be machined into the keel-tipped stylus, then the shapes of the respective envelopes 70 and 71 for each of three different shoulder widths will be as shown in FIG. 9. Envelope 80 is that for the case where the shoulder width is greater than the signal track 43. Envelope 80 corresponds to envelopes 70 and 71 of FIG. 8. Envelope 82 represents the case in which the shoulder 23 of the stylus is equal to the width of the signal track 43 while envelope 84 is that case where the width of the stylus shoulder is less than the width of the signal track 43. The envelope portion 86, of course, is common to the respective envelope portions connected thereto. Although the above discussion is for the case in which the signal track 43 width ($W_{sig}$) and the groove width ($W_T$) are equal, this constraint is unnecessary in practice. When the signal track (43) and the groove (42) are of unequal width, the analysis is somewhat more complicated, but the same information on shoulder width ($W_s$) is obtainable.

In the practice of the invention, one could cut a more coarse signal spiral track 43 than that shown in FIG. 6. A much coarser spiral of the signal track 43, for example, would be one that intersects or crosses the lapping groove 42 at a 45° angle.

Various methods within the skill of the art may be used for mastering a lapping disc 44 according to the invention as described hereinabove. For example, one suitable method comprises cutting the lapping groove 42 mechanically, coating a substrate for the disc with a thin uniform resist layer, either positive or negative acting, and, then exposing the signal elements 43*a* with either a laser or electron beam to record the signal track 43. The resist layer would then be developed down to a depth shallower than the lapping groove depth and could serve as a mask for the etching of the shallow signal track into the copper surface.

If desired, the entire procedure can be done solely by mechanical means. For such an application, the procedure for recording the signal track 43 would involve successive cuts to produce spiral groove 42 and then the spiral signal track 43. The second mechanical cut of the successive cuts in either case may be difficult to perform since it must not be so deep as to obliterate the preceded spiralled cutting. Moreover, removal of chips and the formation of undesired ridges may both be a problem in the procedure of implementing the second cut.

I prefer cutting the groove by mechanical means and preparing the signal track by electronic exposure and chemical processing, as will now be described.

Figure 10:
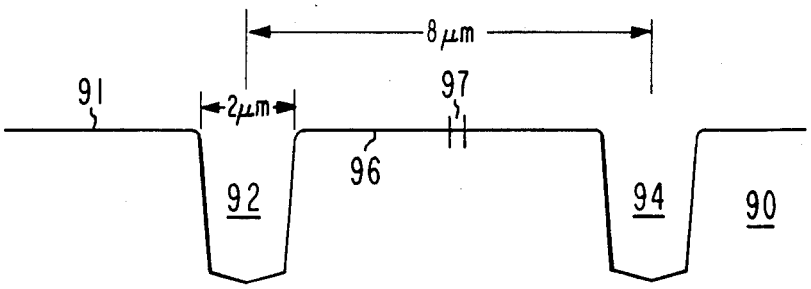
FIG. 10 is a schematic of a master for a lapping disc in a radial cross section showing only the lapping groove.

FIG. 10 is a schematic of a portion of a disc of a metal master 90 from which a keel-lapping disc 44 (FIGS. 4 and 6) is made. The master 90 may be fabricated out of a copper clad aluminum substrate although other materials may be used as well-known in the art. Adjacent grooves 92, 94 of the plurality of grooves of the complete spiral groove shown in cross section, are formed in the surface 91 of the master. Grooves 92 and 94 are segments or elements of the continuous spiral groove that will serve as the master groove for the desired lapping disc groove 42. The grooves are typically 2 μm wide and cut with a cutting stylus approximately 9 μm wide at the shoulders but with an approximate pitch of 8 μm whereby the land portion 96 is made flat by overlapping cuts of about one μm in the land portion 97.

Figure 11:
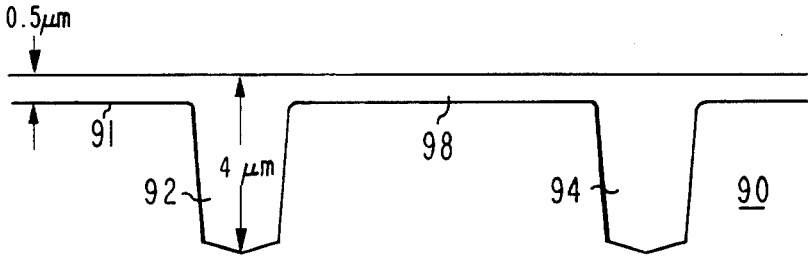
FIG. 11 is a schematic in radial cross section of the master of FIG. 10 overcoated with a photoresist layer.
Figure 12:
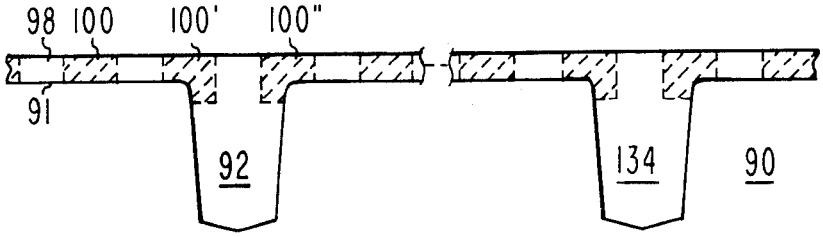
FIG. 12 is a schematic in radial cross section of the illuminated signal track in the photoresist of FIG. 11 after exposure but before development.
Figure 13:
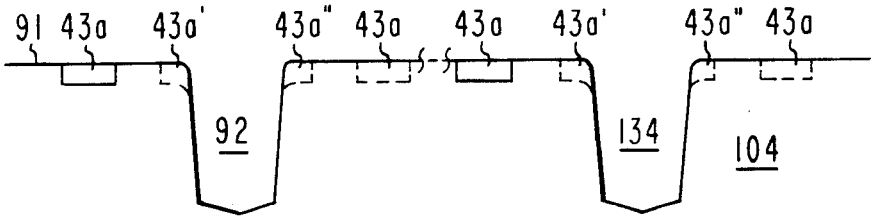
FIG. 13 is a schematic longitudinal view through a portion of the master of FIG. 12 showing the signal track after etching.

The signal track 43 is formed as shown in the sequence shown in FIGS. 11 and 12 and 13, respectively. FIGS. 12 and 13 show for convenience two alternate grooves 92 and 134 as seen, for example, along viewing line 13—13 in FIG. 6. FIG. 11 illustrates the first step of coating the surface of the disc including the grooves 92 and 94 with a thin uniform resist layer 98 of 5000 Angstroms (½ μm) on the surface, filling completely the grooves 92 and 94. A suitable photoresist is Shipley 1350 or Mark II which is baked for 1 hour at 70° C.

Thereafter, signal elements 100 are illuminated into the resist layer 98 with either a laser or electron beam. Preferably, a laser beam is guided radially inwardly over the master disc 90 as the disc is rotated one revolution every 10 seconds at a rate, thus, of 6 RPM. The laser beam is chopped at a frequency of approximately 8 KHz to expose thereby the resist with a spiral track having a pitch of 16 μm with a series of elongated elements 100 ( of a length corresponding to the desired elements 43*a*, FIG. 7). These elements 10°, when converted into corresponding signal elements 43*a* on the playback disc 44 and used in the playback mode, will generate at 225 RPM a playback signal at a frequency of about 300 KHz. This 300 KHz signal is used to monitor the lapping process, as will be further explained.

The resist 98 will then be developed to a depth somewhat shallower than the groove bottom, thus serving as an etch mask for the copper on the upper land surface 91. In order to develop a good relief pattern from the exposed elements 100, I prefer one part of Shipley AZ developer, that is made weak by 3 parts water, to dissolve the resist elements 100 slowly and quite thoroughly down to the copper surface 91 and somewhat into the grooves 92, 94, 134. This development step with this weak solution takes 20 minutes. The resultant developed resist pattern, used as an etch mask, is removed after the etching of the copper leaving signal elements in the surface of the copper 90, which elements will appear in plan view as shown in FIGS. 6 and 7. Elements 43*a*, etc., in FIG. 13 are identical to elements 43*a*, etc., of FIG. 7. The etched elements 43*a*′ and 43*a*″, it will be noted, result from the development of the exposed elements 100′ and 100″ shown in FIG. 12. Since a portion of each of exposed elements 100′ and 100″ is within the upper portion of the photoresist 98 in groove 92, only the portion over the land surface 91 will effect etching in the surface 91.

In order to insure the proper development and etching of the desired signal elements 100 etc. into the copper surface 91, I have discovered that the development and etching process steps must be done in an environment in which the surface 91 of master 90 is kept wet. Moreover, I have discovered that the etching liquid should be weak in order to control the depth of the etch. Accordingly, after the development step, the surface is washed very thoroughly with water to remove all residue of the developing agent. Next, with the surface still wet, I provide an etchant of a weak solution etchant of 0.1% ferric chloride ($Fe_2Cl_3$) in order to control the depth of etch into the copper surface 91 by the slow etchant resulting from the weak etchant. If the surface is not kept wet from the start of the development process until the completion of the etching process, residue photoresist material may redeposit on the surface and cause an improper etching of the surface. The period of time needed for the weak solution copper etch step is about 60 seconds. The etching step is followed by a thorough washing with water to remove the etching solution.

Thereafter, the surface is washed with a solvent, such as acetone, to dissolve the remaining photoresist material 98 that served as the mask during the etching step. The resultant etched master is as shown in FIG. 13 wherein the full-size signal elements 43*a* are shown in the land surface 91. The elements that happened to overlap or extend over the edges of the groove would be partial elements as shown as 43*a'* and 43*a''*. The depth to which the signal elements are etched in the surface 91 should be large enough that the capacitance playback signal is nearly saturated but not so large that the edges of the signal elements 43*a* become distorted during etching. A reasonable compromise on the depth of the etched elements 43*a*, etc. is about 2,000 Angstroms (0.2 micrometer).

The master disc 104 shown in FIG. 13 formed from the metal master 90 is now used to generate a metal stamper by nickel plating. The nickel plated metal stamper is then used to press the plastic discs that are to be used for lapping. The lapping discs may be made from any material that will reproduce faithfully the groove shapes with the etched signal elements 43*a* etc. A metal layer is sputtered onto the surface of the plastic disc. This metal layer serves as the ground plane for a capacitor, the stylus electrode (35, FIG. 2) being the other plate. An abrasive material such as $SiO_x$ where x has a value between 1 and 2 is then deposited on the surface of the metal to form an abrasive layer 69 as shown in FIGS. 4 and 5. FIG. 4*a* shows, in simplified form, the lapping disc without the abrasive layer 69 but with the signal track element 43*a*, etc.

A specific example of formation of such a master disc 104 is as follows:

EXAMPLE

A mechanically cut, deep-grooved, keel lapping disc master was prepared from a 14-inch (35.5-centimeters) copper-coated disc record using a keel-tipped cutting stylus. A continuous sprial groove was machined over the disc master surface area between an inner radius of 2.8 inches (7.1 centimeters) and an outer radius of 5.8 inches (14.7 centimeters). The grooves 92, 94, 134 were about 2.4 micrometers wide and 4 micrometers deep. The groove pitch was 8 micrometers.

The copper master was uniformly coated with 20 cc of photoresist solution consisting of a 15 percent weight of solids to the volume of solution. The exposure, development, etching, replication disc pressing, metallizing and abrasive coating steps were performed as described hereinabove.

Figure 4:
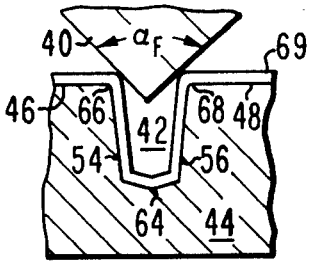
FIGS. 4, 5, and 5*a* show a playback stylus during the lapping process.

In the practice of the invention, for use in lapping a stylus, a starting stylus 40 (FIG. 4) having a faceted tip is positioned as shown in FIG. 4 in the groove 42 and is thereafter lapped to have a keel-tip and shoulders as shown in FIG. 5 designated as stylus 40'. The stylus 40' formed thereby has a keel 19 with a conforming V-surface 64 and shoulder portions 21 and 23. Signal track portions 43*a*, 43*a'*, and 43*a''* corresponding, respectively, to the portions of signal track 43 on the land on either side of the groove 42 and those signal elements extending into the groove 42 of FIG. 4, are positioned relative to shoulders 21 and 23 of stylus 40' as shown for convenience in FIG. 5*a*. The relative signal amplitudes generated between the stylus portion over the signal track portions 43*a*, 43*a'*, 43*a''* depend upon the respective widths of the shoulder portions 21 and 23. If the shoulder portions 21 and 23 are equal in dimension, then the signals 70, 71 will be equal, on the average, for one turn of the stylus 40' in the groove 42. If there is asymmetry in the respective widths of the shoulder portions 21 and 23, then the envelopes 70, 71 of the respective signals will be different as the differences in the respective shoulder widths.

The length (L) of the shoe of the stylus is shown in FIG. 16. The shoulder width ($W_s$) and keel tip width $W_k$ and depth D are shown in the rear view FIG. 15. The stylus shoe length (L) can be determined based on the relationship of the shoe length to the facets of the stylus as explained and defined by equation (1) above. Accordingly, for a given stylus design, the invention may be practiced to determine the shoe length (L) based on the capacitance signal amplitude sensed between the electrode of the stylus as it passes over the signal track period.

A suitable system for sensing the length (L) of the shoe indirectly by measuring the width ($W_s$) of the stylus shoe is shown in FIG. 14. FIG. 14 includes a turntable 110, rotated by a shaft 112, carries the playback disc 45. A stylus 40' riding in the grooves 42 of the playback disc provides a capacitive varying signal (FIG. 8) to an amplifier 114. The amplifier 114 generates a signal which is detected by an envelope detector 116 providing, in turn, an output signal similar to that shown in FIG. 9, to a display 118, or, if desired to a computer and processer 120. As long as the shoulder width being lapped is less than the desired width, the lapping process will continue. When the desired width of the shoulders 21 and 23 are reached, the computer 120 provides a signal to stop lap device 122 to energize the lifting mechanism 124 to lift the stylus 40' from the groove to thereby stop further lapping of the stylus.

FIG. 9, as previously described, illustrates the envelope amplitude of the signal recovery. It will be appreciated, thus, that as the shoulder of the stylus is less than the width of the signal 43*a*, the amplitude of the envelope would be substantially as indicated by waveform 84. As the shoulder width become equal to the signal width the waveform will assume the shape of waveform 82 and if the shoulder width is allowed to become greater than the signal width, the waveshape will be as indicated by reference 80. Accordingly, the lapping disc of the invention can be used as a test means of the stylus that has already been formed by simply monitoring the signal sensed by the stylus shoulders passing through the groove. Accordingly, the waveshapes of FIG. 9 can be used to indicate whether the stylus shoulder is of the desired width or is of a width greater than or less than a standard.

As indicated hereinabove, the desired manufacturing criterion is the length (L) of the shoe of the stylus shown in FIG. 16. The length L is not measured directly using the lapping disc of the invention. Rather the shoulder widths 21 and 23 shown in FIG. 15 are measured. But, in accordance with equation (1), the length L is related to the shoulder width and the lapping process of the invention can be used to determine length L by measuring directly the shoulder width.

As shown also in FIG. 15, the shoulder (21 or 23) is not entirely perpendicular to the lapping keel 19. In general, the shoulder has a rounded surface as at portions 21*a* and 23*a*. Nevertheless, the technique of determining the width of the shoulder is substantially accurate when it is understood that the precise width $W_s$ is based on the length L indicated at FIG. 15. The rounded corners (21*a* and 23*a*) of the shoulders is ignored in this measurement. The actual difference between the theoretical and actual length is trivial.

What is claimed is:

1. An article for lapping a member wherein the article comprises a spiral abrasive groove and a signal which is recorded in the article's land surface from a spiral signal track which crosses the abrasive groove and wherein the signal can be sensed by means of the member.

2. A lapping apparatus comprising an article having an abrasive groove, a signal recorded in the land surface of the article as a portion of a signal track which crosses the abrasive groove, a member which is to be lapped; and means for establishing relative motion between the abrasive groove and the member;

whereby a signal indicative of a dimension of said member can be recovered from said track by means including said member for sensing said signal.

3. A method for determining a dimension of a member while it is being lapped comprising the steps of:

providing an abrasive spiral groove of predetermined cross-sectional shape in an article;

recording a signal in the article in the land thereof as a spiral signal track which crosses the abrasive groove and the signal of which can be recovered by signal sensing means which include the member;

establishing relative motion between the member and the abrasive groove containing the member for lapping the member to a shape complementary to the shape of the groove while recovering the recorded signal from the land with the sensing means until the recovered signal indicates the member has attained the desired dimension.

4. A method for measuring the width of a stylus having an electrode comprising the steps of:

forming a spiral groove of a given width in a substrate, recording a spiral signal track in the land of the substrate which intersects the groove, placing the stylus in the groove, establishing relative motion between the stylus and the substrate maintaining the stylus in the groove; and sensing the signal recovered by means of the stylus electrode when the stylus electrode is in the vicinity of the signal track.

5. The method of claim 4 wherein the length of the stylus is determined by measuring the width of the electrode, and calculating the length of the stylus based on the relationship of the length as a function of the width and a predetermined constant.

6. The method of claim 4 wherein said substrate is a circular disc and wherein said signal track is formed in the land as elongated signal elements each having a traverse dimension that approximates the width of the groove and that is substantially parallel to the radius of said disc.

* * * * *